United States Patent [19]

Cunningham

[11] Patent Number: 4,538,814

[45] Date of Patent: Sep. 3, 1985

[54] TRIFUNCTIONAL GOLFING CAGE

[76] Inventor: William J. Cunningham, P.O. Box 888, Hackettstown, N.J. 07840

[21] Appl. No.: 646,781

[22] Filed: Sep. 4, 1984

[51] Int. Cl.[3] ..... A63B 69/36; A63B 57/00

[52] U.S. Cl. ..... 273/176 F; 273/178 B; 273/179 C; 273/181 F; 273/182 A

[58] Field of Search ..... 273/182 R, 182 A, 181, 273/179, 176 F, 176 FA

[56] References Cited

U.S. PATENT DOCUMENTS

| | | | |
|---|---|---|---|
| 1,667,481 | 4/1928 | Lange et al. | 273/179 B |
| 1,677,442 | 7/1928 | Hall | 273/181 A |
| 1,899,860 | 2/1933 | Flower | 273/179 B X |
| 1,960,113 | 5/1934 | Kohirogawa | 273/176 F |
| 2,043,273 | 6/1936 | Watson | 273/181 A |
| 2,061,973 | 11/1936 | Loeb | 273/182 R |
| 2,379,663 | 7/1945 | Smith | 273/182 A |
| 3,227,449 | 1/1966 | Schwab | 273/181 F X |
| 3,260,527 | 7/1966 | Younce | 273/182 A X |
| 4,153,246 | 5/1979 | Byrne | 273/181 F |
| 4,215,865 | 8/1980 | Pilati | 273/182 A X |

FOREIGN PATENT DOCUMENTS

| | | | |
|---|---|---|---|
| 408944 | 4/1934 | United Kingdom | 273/181 F |

*Primary Examiner*—Paul E. Shapiro

*Attorney, Agent, or Firm*—Kenneth P. Glynn

[57] ABSTRACT

The present invention is a trifunctional golfing cage having an elongated flat playing surface base with a tee off area at its front, a free standing frame, a first netting connected to the frame so as to enclose sides, back and top areas of the base, a second netting hanging down in front of the back portion of the first netting, a third netting hanging down in front of the second netting, and a cup located in the base. The second netting is a driving "loose drop" netting which hangs down at least 75% of the height of the cage to stop driven golf balls. The third netting is a chipping "loose drop" netting much shorter than the second netting and is a chipping "loose drop" netting. The cup is strategically located for putting. Return trough(s) may be employed to return the hit balls back to the front of the base, e.g. by gravity. An optional fourth netting may be employed to enhance deflection of chipped golf balls.

20 Claims, 11 Drawing Figures

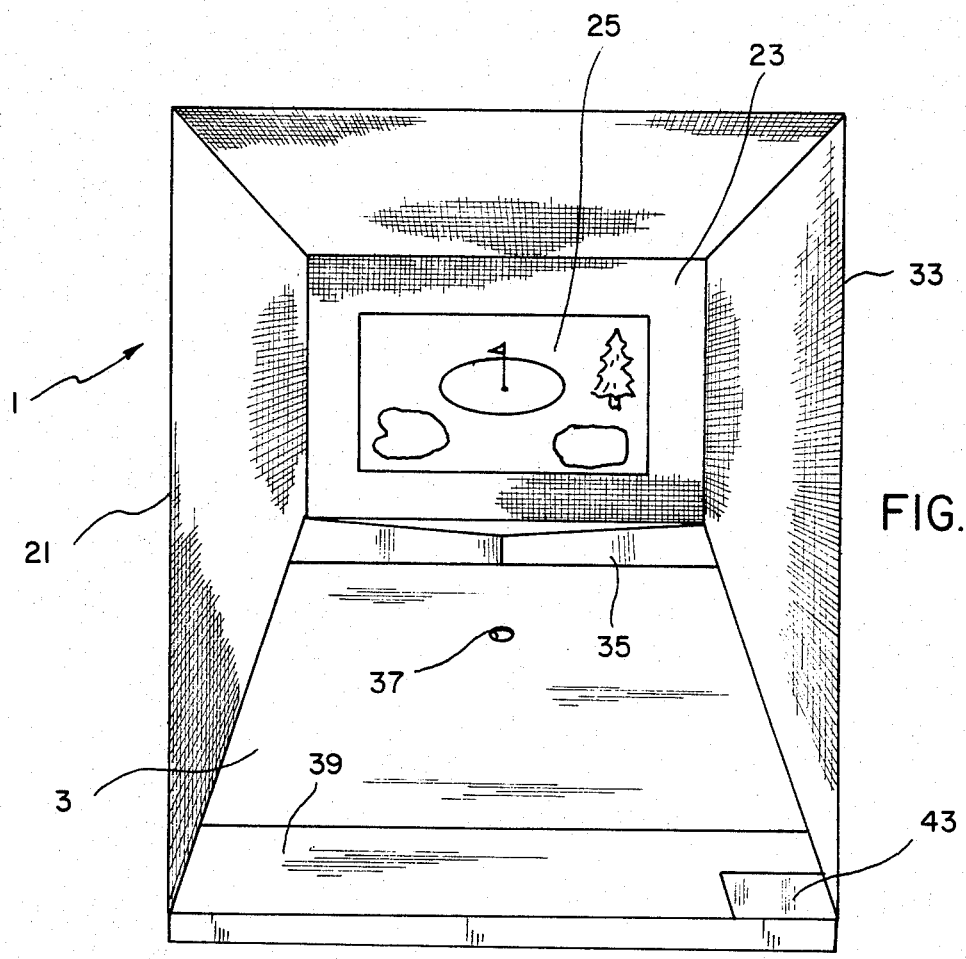
FIG. 2
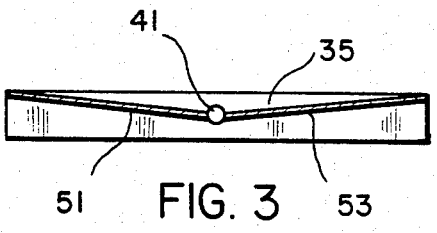
FIG. 3
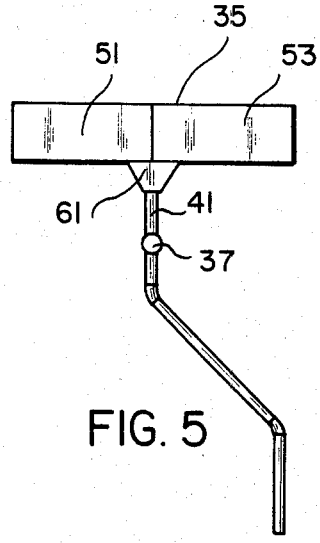
FIG. 5
FIG. 4
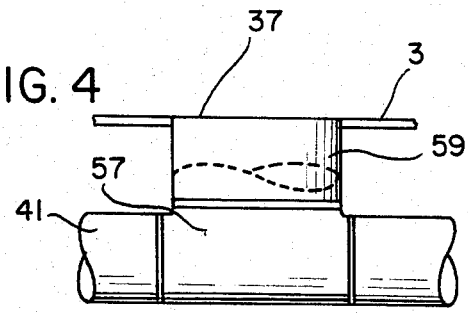

TRIFUNCTIONAL GOLFING CAGE

BACKGROUND OF THE INVENTION

1. Field of the Invention

The present invention is directed to a golfing cage which may be used for practice sessions, for pre-game warm-ups and/or for exercise. More specifically, the present invention is directed to a trifunctional golfing cage which has been uniquely developed to permit the user to drive, to chip and/or to putt. Further, the golfing cage of the present invention may be used indoors or outdoors and may be used privately or in commercial environments. It is particularly useful as a supplemental activity at the country club and public golf course.

2. Prior Art Statement

U.S. Pat. No. 3,411,788 to Blanding, U.S. Pat. No. 1,935,291 to Gardner et al., U.S. Pat. No. 1,889,813 to Smith, U.S. Pat. No. 1,669,640 to Warlick, U.S. Pat. No. 1,660,339 to Kaufmann and U.S. Pat. No. 1,543,401 to Steinmetz are all directed to various golf practice equipment which includes caging which utilizes netting to cover the top sides and back of an enclosed hitting range whereby golf balls may be driven from a tee off area and contained within the cage. Various embodiments include gravity return of the ball. Notwithstanding this significant collection of prior art, none of these references teach a self-contained trifunctional golfing cage which utilizes a plurality of tailor designed netting to optimize utilization of the cage for putting, chipping and driving. In fact, none of these prior art references show a second netting which is loose dropped for driving a third netting which is much shorter and is loose dropped for chipping.

U.S. Pat. No. 3,156,471 to Bibeau, U.S. Pat. No. 2,123,195 to Middleton, U.S. Pat. No. 1,969,139 to Knapp, U.S. Pat. No. 1,745,201 to Alston, U.S. Pat. No. 1,469,130 to Whitehair and U.S. Pat. No. 1,012,820 to Cory all teach other types of golf practicing apparatus with partial netting and/or return troughs, but these references add nothing to the shortcomings of the abovementioned references and likewise fail to teach the criticality of the plurality of custom tailored nettings employed in the advantageous trifunctional golfing cage of the present invention.

SUMMARY OF THE INVENTION

The present invention is a trifunctional golfing cage having an elongated flat playing surface base with a tee off area at its front, a free standing frame, a first netting connected to the frame so as to enclose sides, back and top areas of the base, a second netting hanging down in front of the back portion of the first netting, a third netting hanging down in front of the second netting, and a cup located in the base. The second netting is a driving "loose drop" netting which hangs down at least 75% of the height of the cage to stop driven golf balls. The third netting is a chipping "loose drop" netting much shorter than the second netting and is a chipping "loose drop" netting. The cup is strategically located for putting. Return trough(s) may be employed to return hit balls back to the front of the base, e.g. by gravity.

BRIEF DESCRIPTION OF THE DRAWINGS

The invention will be described in detail in conjunction with the drawings in which:

FIG. 2 is an inside view of the rear wall of the cage as seen from the player's tee off area;

FIG. 3 is a frontal view depicting the incline of a trough located below the playing surface, immediately in front of and beneath the first netting;

FIG. 4 is a side view of the cup hole and a portion of an optional ball return trough;

FIG. 5 is a top plane view of a gravity trough with the playing surface removed;

DETAILED DESCRIPTION OF THE INVENTION, INCLUDING THE DRAWINGS

Figure 1:
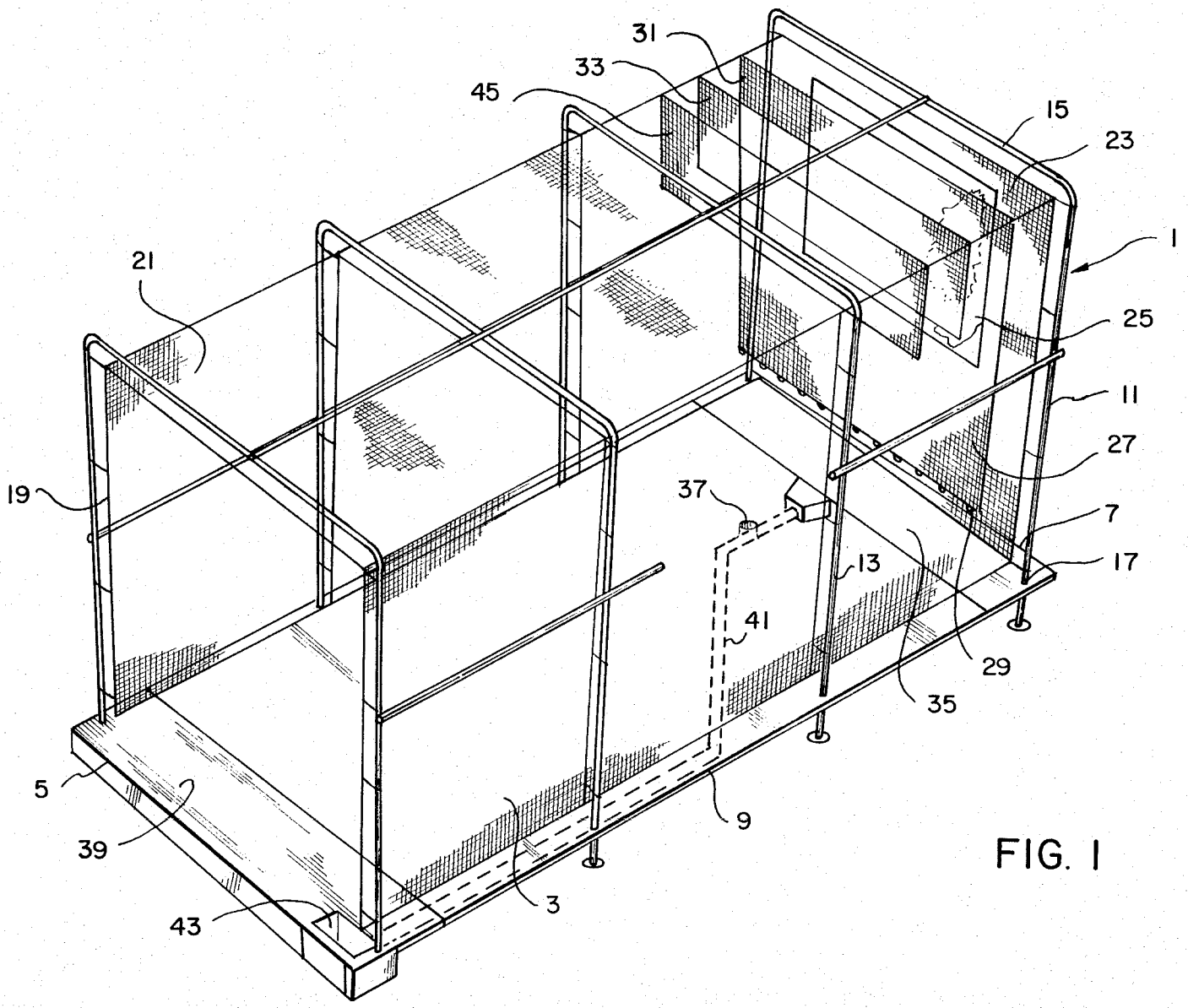
FIG. 1 is a perspective view through one embodiment of the entire golfing cage of the present invention showing the general arrangements of the various components.

It is the object of this invention to provide a golf training and exercise cage which is uniquely trifunctional. Thus, the present invention golfing cage permits the player to practice various golf strokes within a small area so that the player may practice during the off season, as well as warm up prior to actual play during the season, and attain greater skill in playing golf through use of this training apparatus. It is intended for practice in the open air or indoors depending on the season of the year, weather conditions, and player preference, and to permit the player to practice all three phases of the game of golf; i.e., driving, chipping, and putting within the enclosed cage.

The individual using the present invention trifunctional golfing cage stands at the front (opened end) of the cage and after selecting an appropriate golf club, places a ball on a tee or on the optional artificial grass surface, and then elects to either drive or chip the ball into the rear netting or putt the ball into the cup. Once the ball reaches the rear impact netting or is sunk in the cup, it may be returned via a gravity trough system to the player's area where it may come to rest in an unsecured or secured (locked) storage box.

The cage consists of an enclosed playing area, a playing surface base, which may optionally be covered with a simulated grass, and is a flat surface with a tee off area at its front and an open trough at the back end of the cage below the rear impact netting, a cup which is in the playing surface centered between the side walls, and located between the tee area and the rear impact area; a trough located at the end of the cage and below the impact net area; side walls, top wall and end wall of a first netting material with the end wall optionally having a picture of a golf green imposed upon the netting to simulate actual play; a free standing frame structure to support the netting on the sides, top and back wall; an optional gravity ball return trough which connects the rear impact area trough, e.g. to the putting cup, and to a storage box, thus providing return of the golf balls to the area without the necessity of picking up balls within the cage; the storage box for the golf balls may be locked and may be either key or coin operated to permit release of a specified number of balls for use by a given player.

In addition to the first netting which basically constitutes the cage netting and encompasses sides, top and back, and in conjunction with the frame, comprises the sides, top and back portions of the cage there is a second netting which drops down from and is attached to the top portion of the cage. This second netting has a width approximately the same as the back of the first netting and is located at least six inches, and preferably six inches to two feet in front of the back portion of the first netting. Further this second netting hangs down at least 75% of the height of the cage, i.e. of the height of the first netting and has weights located at its bottom to prevent the second netting from flying up and getting tangled when impacted by a hit ball. This second netting thus has weights of substantial mass to substantially hold the second netting sufficiently to slow down or stop a driven golf ball. It constitutes a driving "loose drop" netting which, in conjunction with the back portion of the first netting, stops a driven golf ball and drops it into a receiving trough.

Further, the present invention golfing cage critically includes a third netting which drops down from and is attached to the top portion of the cage and located at least six inches in front of the second netting. This third netting has a width approximately the same as the bae and a hanging length of no more than 35% of the height of the first netting. This third netting is preferably six inches to two feet in front of the second netting and constitutes a chipping "loose drop" netting which acts to stop chipped golf balls.

In a preferred embodiment of the present invention, a fourth netting may be included which has approximately the same dimensions as the third netting, hangs down from the top portion of the cage, and is located at least six inches, and preferably six inches to two feet, in front of the third netting so as to act as a second chipping "loose drop" netting.

In one preferred embodiment, the base of the present invention trifunctional golfing cage may be constructed modularly in, for example four segments of structural plastic which may be snapped or otherwise assembled together.

Other features, objects and advantages of the invention will become apparent from the following description and drawings.

In the accompanying drawings forming part of this application, and in which like numerals are employed to designate like parts through the same:

FIG. 1 shows a perspective cut view of one embodiment of the trifunctional golfing cage of the present invention, shown generally as 1. Elongated flat playing surface base 3 is shown as the principal horizontal "floor" surface of the cage and may be constructed of plywood, plastic or metal and may optionally include an artificial turf surface. Base 3 may be unistructural, or an assemblage of modular segments, as desired. For example, it may comprise four plastic molded quadrants which snap or clamp together. Base 3 is shown as having a front 5, a back 7 and sides 9.

Another essential feature of trifunctional golfing cage 1 is free standing frame 11. By "free standing" is meant not necessarily attached to any vertical members for support purposes. Typical frame side member 13 and top member 15 of frame 11 are shown. Location 17 illustrates a connecting point between frame 11 and base 3. In this embodiment, the connecting point at location 17 involves tubing of frame 11 fitted through drilled holes in base 3. Alternatively, any conventional fastening means to connect free standing frame 11 with base 3 could be employed.

First netting 19 is partially shown. Details of side 21 and back 23 of first netting 19 are shown in detail. Top and right side portions are only outlined so as to permit the drawing to clearly illustrate other features of the invention. First netting 19 has a weave and strength fine enough to contain a driven golf ball, said first netting 19 constituting a continuous closure connected to frame 11 and enclosing said base 3 from above, on its sides and to its back. Thus, frame 11 and first netting 19 constitute the sides, back and top portions of trifunctional golfing cage 1.

Also shown in FIG. 1 is optional ilustration 25 which is a graphic illustration of a golf green with foliage, hazards and fairway to simulate actual playing conditions. As shown in FIG. 1, illustration 25 is located on the back of first netting 19.

Second netting 27 is shown hanging from the top of trifunctional golfing cage 1 above base 3. It has a width approximately equal to the width of base 3 and preferably a width equal to the width of back 23 of first netting 19. Second netting 27 has a hanging length of at least 75% of the height of back 23 of first netting 19. Second netting 27 is secured at its top 31 by any conventional stringing or other attaching technique and contains weights 29 at its bottom, weights 29 having sufficient mass to at least partially hold down second netting 27 when hit by a driven golf ball and so as to thereby substantially slow down or stop the driven golf ball. Finally, second netting 27 is located at least six inches in front of back 23 of first netting 19. Essentially, second netting 27 and first netting 19 act together to completely stop a driven golf ball, second netting 27 thereby constituting a driving "loose drop" netting.

Third netting 33 is shown hanging from the top portion of trifunctional golfing cage 1 above base 3 and has a hanging length of no more than 35% of the height of back 23 of first netting 19. Third netting 33 is unsecured at its bottom and does not necessarily require weights. Third netting 33 is located at least six inches in front of second netting 27 such that third netting 33 acting alone will stop, or deflect substantially downwardly a chipped golf ball. Thus, third netting 33 constitutes a chipping "loose drop" netting.

Receiving trough 35 is shown located toward the back 7 of base 3 and is about as wide as first netting 19. As shown, receiving trough 35 is tapered toward the center and golf balls driven or chipped in trifunctional golfing cage 1 drop into receiving trough 35 and may, by gravity, return to the front 5 of base 3 via optional sloped return trough 41, and ultimately into optional return trough storage box 43. Also shown is cup 37 which is located some distance in front of trough 35, as desired, and is used for putting. As shown, cup 37 may optionally be connected to return trough 41.

Elongated flat playing surface base 3 includes a tee off area 39 from which golf balls may be driven, chipped, or putted. For particularly strong golfers, or for use in environments involving high levels of usage, optional fourth netting 45 may be included. This fourth netting 45 would constitute a second chipping "loose drop" netting and would be approximately the same as third netting 33 and located at least six inches in front of third netting 33.

FIG. 2 shows an inside frontal view of the trifunctional golfing cage 1 shown in FIG. 1. However, all netting except for first netting 33 have been removed to illustrate a golfer's eye view of the netting itself which, in conjunction with frame 11, constitutes the cage. Components which are identical in both figures are identically numbered. Shown are first netting 33, as mentioned, base 3, tee of area 39, cup 37, trough 35, illustration 25, storage box 43, etc.

FIG. 3 is a frontal cut view of trough 35 and the beginning of sloped return trough 41, in this case, comprised of plastic tubing of sufficient diameter to allow golf balls to pass therethrough via gravity to storage box 43. As shown the bottom portions 51 and 53 of the trough are tapered toward the center. They may optionally be tapered forward and preferably are tapered forward.

FIG. 4 shows cup 37 in base 3 and its connection to a portion of sloped return trough 41. Exaggerated T-pipe 57 and extension 59 are shown as one means for tying cup 37 into sloped return trough 41.

FIG. 5 shows a top plane view of receiving trough 35 and its floor boards 51 and 53 as well as cut out 61, sloped return trough 41 and putting cup 37. This arrangement is, of course, optional and any viable arrangement may be employed.

Figure 6:
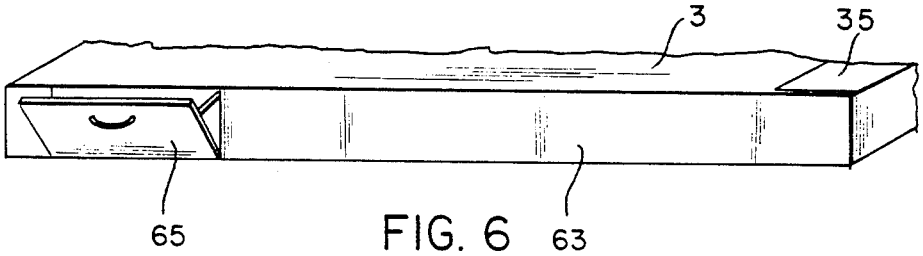
FIG. 6 is a side view of a golf ball box.

FIG. 6 shows an alternative storage box arrangement wherein base 3 includes sidewall 63 and drawer 65.

Figure 7:
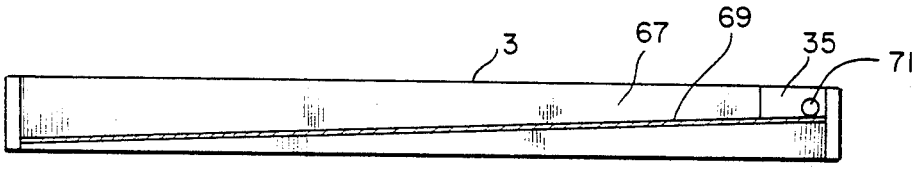
FIG. 7 is a plane view of the inside of a trough and the storage box of FIG. 6.

FIG. 7 illustrates a plane cut side view of a sloped return trough 67. In this case, tubing is not used but instead tapered channel 69 having a rectangular cross-section is employed. Also shown is a cut section of receiving trough 35 having golf ball 71 contained therein.

Figure 8:
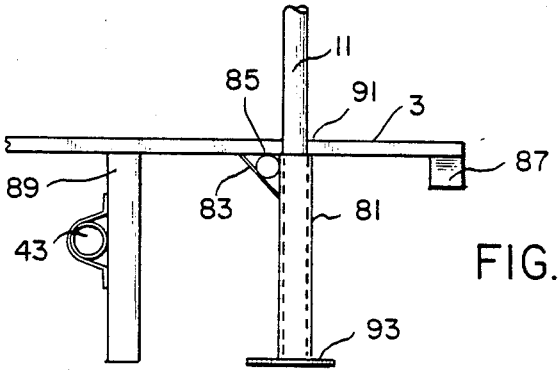
FIG. 8 is a front view one embodiment of a portion of a free standing metal frame base which may be used in the present invention.
Figure 9:
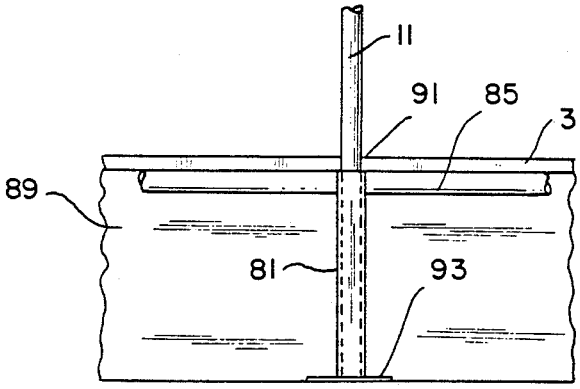
FIG. 9 is a side view of a portion of the free standing frame base of FIG. 8.

FIG. 8 is a front view of one embodiment of free standing metal frame 11 having jacket 81 located below base 3 and triangular angle iron 83 supporting cross-member tubing 85. Base 3 in this embodiment may be plywood and may be structurally supported by cross-members 87 and legs 89. Frame 11 is not only supported by jacket 81, bracket 83 and cross-member 85, but is also supported by foot pod 93. Sloped return trough 43 is shown in its cross-section as bracketed to leg 89. FIG. 9 shows a side view of a portion of that which is shown in FIG. 8 and like parts are like numbered. As can be seen in both figures, frame 11 is further supported by being tightly fitted through hole 91 in base 3. FIG. 9 clearly illustrates that leg 89 may run the full width or a substantial width of base 3.

Figure 10:
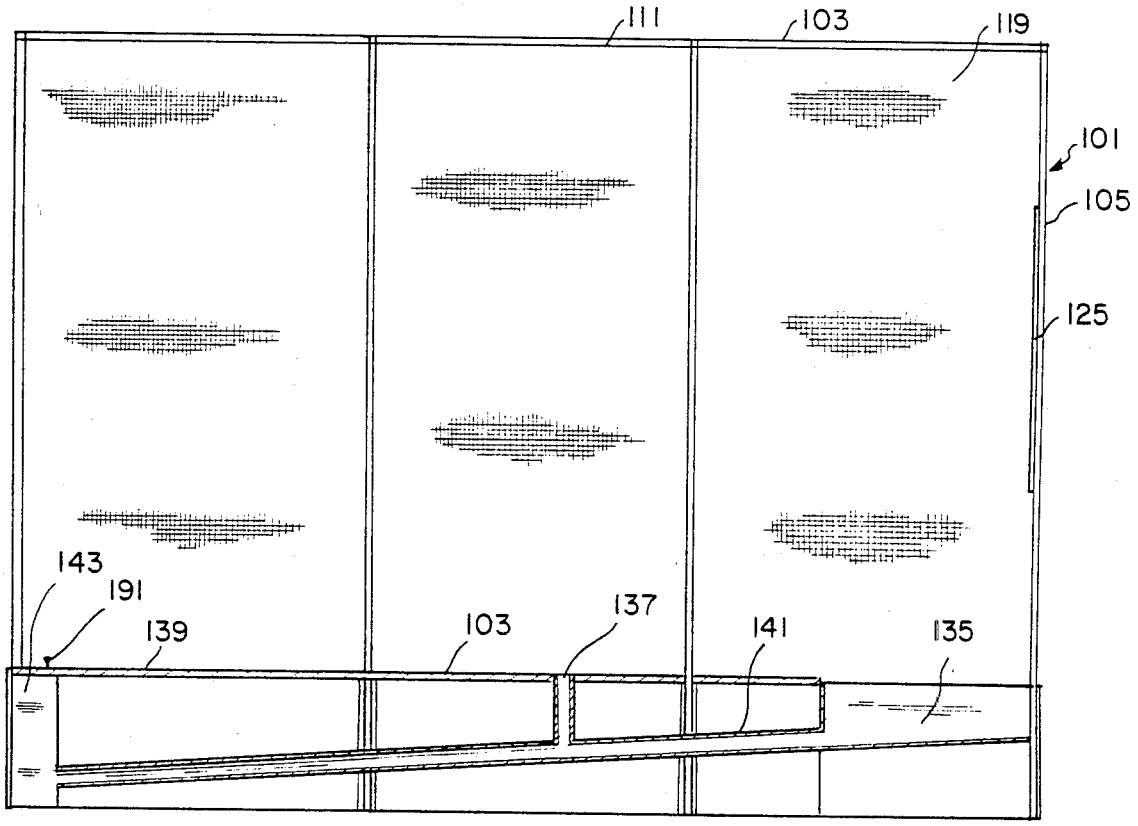
FIG. 10 is a side view of a present invention trifunctional golfing cage with a cut view of the trough ball return system to a storage box; and, FIG. 11 is a cut frontal view showing one possible attachment of the first netting to a frame.

FIG. 10 shows a side view of a trifunctional golfing cage 101 having a top portion 103 and a back portion 105 which are formed by first netting 119 and frame 111. Illustration 125 is attached to back portion 105. Trough 135 is shown along with sloped return trough 141, cup 137, base 103, tee off area 139, storage box 143 and tee 191.

Figure 11:
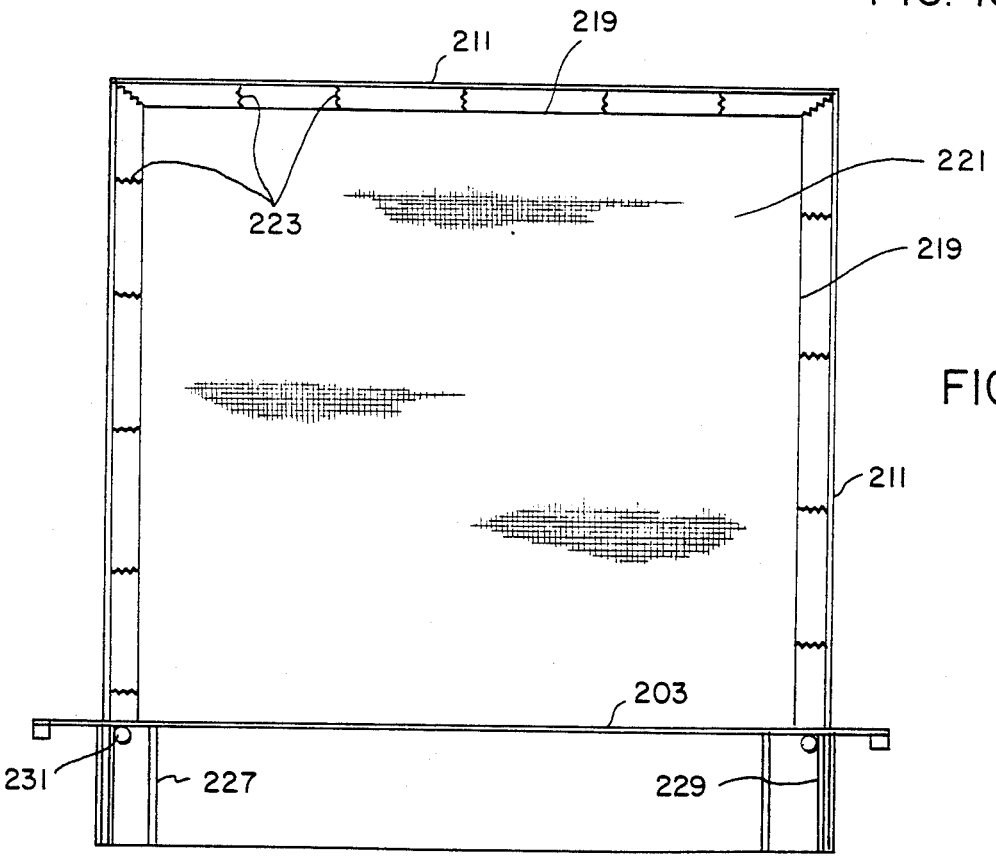

FIG. 11 illustrates a cut frontal view showing one possible means of attachment of the various components forming a trifunctional cage of the present invention. Shown in base 203, frame 211, first netting 219, back 221 of first netting 219 (without illustration), attachment strings 223, support legs 227 and 229 and frame cross-member supports 231.

Obviously, numerous modifications and variations of the present invention are possible in light of the above teachings. It is therefore to be understood that within the scope of the appended claims, the invention may be practiced otherwise than as specifically described herein.

I claim:

1. A trifunctional golfing cage comprising:

(a) an elongated, flat playing surface constituting a base having a front, a back and sides, and being at least 8 feet wide and 15 feet in length;

(b) a free standing frame having a plurality of side members and a plurality of top members at least 10 feet in height, said frame being connected to said base;

(c) a first netting having a weave and strength fine enough to contain a driven golf ball, said netting constituting a continuous closure connected to said frame and enclosing said base from above, on its sides and to its back said frame and said first netting thereby comprising sides, back and top portions of said cage;

(d) a second netting hanging from the top portion of said cage and located above said base, said second netting having a width approximately equal to the width of said base and having a hanging length of at least 75% of the first netting height, said second netting being unsecured at its bottom and having weights contained at its bottom of sufficient mass to substantially slow down or stop a driven golf ball, said second netting being located at least six inches in front of the back portion of said first netting such that the second netting and first netting acting together will stop a driven golf ball, said second netting thereby constituting a driving loose drop netting;

(e) a third netting hanging from the top portion of said cage and located above said base and having a hanging length of no more than 35% of the first netting height, said third netting being unsecured at its bottom and being located at least six inches in front of said second netting such that the third netting acting alone will stop or deflect substantially downwardly a chipped golf ball, thereby constituting a chipping loose drop netting;

(f) a receiving trough located at the back of said base to receive hit golf balls which drop from said netting;

(g) a cup located in said base away from the front of said base so as to constitute a putting hole; and, (h) a tee off area at the front of said base located so as to permit driving, chipping and putting.

2. The trifunctional golfing cage of claim 1 further comprising a fourth netting being connected to and hanging from the top portion of said cage and located above said base and having approximately the same dimensions as said third netting but located at least six inches in front of said third netting so as to constitute a second shipping loose drop netting.

3. The trifunctional golfing cage of claim 2 further including a sloped return trough whereby golf balls are returned from the receiving trough at base to the front of the base by gravity.

4. The trifunctional golfing cage of claim 3 wherein said putting hole has a conduit connected to said return trough whereby golf balls are returned from said putting hole to the front of the base by gravity.

5. The trifunctional golfing cage of claim 4 wherein said base includes an artificial turf surface.

6. The trifunctional golfing cage of claim 4 further comprising a graphic illustration of a golf green with foliage, hazards and fairway to simulate actual playing conditions, said illustration being located behind the back of said first netting and attached to said cage.

7. The trifunctional golfing cage of claim 3 wherein said base includes an artificial turf surface.

8. The trifunctional golfing cage of claim 3 further comprising a graphic illustration of a golf green with foliage, hazards and fairway to simulate actual playing conditions, said illustration being located behind the back of said first netting and attached to said cage.

9. The trifunctional golfing cage of claim 2 wherein said receiving trough is pitched toward a center area for ball return, said pitch being from side to side downwardly towards the middle thereof.

10. The trifunctional golfing cage of claim 9 wherein said base includes an artificial turf surface.

11. The trifunctional golfing cage of claim 9 further comprising a graphic illustration of a golf green with foliage, hazards and fairway to simulate actual playing conditions, said illustration being located behind the back of said first netting and attached to said cage.

12. The trifunctional golfing cage of claim 2 wherein said base includes an artificial turf surface.

13. The trifunctional golfing cage of claim 2 further comprising a graphic illustration of a golf green with foliage, hazards and fairway to simulate actual playing conditions, said illustration being located behind the back of said first netting and attached to said cage.

14. The trifunctional golfing cage of claim 1 wherein said base includes an artificial turf surface.

15. The trifunctional golfing cage of claim 1 further comprising a graphic illustration of a golf green with foliage, hazards and fairway to simulate actual playing conditions, said illustration being located behind the back of said first netting and attached to said cage.

16. The trifunctional golfing cage of claim 1 wherein said frame is comprised of three or more continuous tubing pieces, each running vertically from one side of said base across the top above said base and down vertically to the opposite side of said base.

17. The trifunctional golfing cage of claim 1 further comprising a return trough and storage box which is secured from direct removal of golf balls entering said return trough.

18. The trifunctional golfing cage of claim 17 wherein said secured return trough and storage box has a lock system and wherein access to said secured return trough to remove golf balls entering therein is by insertion of a key.

19. The trifunctional golfing cage of claim 17 wherein said secured return trough has a coin activated mechanism and access thereto is by insertion of one or more coins.

20. The trifunctional golfing cage of claim 1 further comprising a return trough located at the back of said base and running to the front of said base, said return trough further being located such that a portion thereof runs directly under said putting hole.

* * * * *